United States Patent [19]

Hart

[11] 4,005,677

[45] Feb. 1, 1977

[54] APPARATUS FOR CIRCUMNAVIGATING A DISPENSER ABOUT A PIPE OR THE LIKE

[75] Inventor: Robert J. Hart, Tulsa, Okla.

[73] Assignee: Commercial Resins Company, Tulsa, Okla.

[22] Filed: Mar. 6, 1974

[21] Appl. No.: 448,670

[52] U.S. Cl. ..... 118/307; 118/DIG. 11

[51] Int. Cl.[2] ..... B05C 5/00; B05C 19/00

[58] Field of Search ... 118/208, 307, 305, DIG. 11; 15/88, 104.04; 134/181, 180, 166 C, 168 C; 51/11; 239/184; 266/23 N, 23 NN, 56

[56] References Cited

UNITED STATES PATENTS

| | | | |
|---|---|---|---|
| 1,796,691 | 3/1931 | Jansen | 118/307 X |
| 1,920,932 | 8/1933 | Finley | 118/DIG. 11 |
| 2,284,711 | 6/1942 | Anderson | 266/23 N |
| 2,357,144 | 8/1944 | Stair | 118/307 |
| 2,476,299 | 7/1949 | Hirsh | 118/DIG. 11 |
| 2,596,322 | 5/1952 | Zumwalt | 266/23 N X |
| 2,808,255 | 10/1957 | Darcy et al. | 266/23 NN |
| 2,821,162 | 1/1958 | Robinson et al. | 118/208 |
| 2,858,555 | 11/1958 | Medovick | 118/307 X |
| 2,914,891 | 12/1959 | Nix | 266/23 NN X |
| 3,464,685 | 9/1969 | Schreib | 266/23 NN |
| 3,847,353 | 11/1974 | Wynne | 118/307 X |

*Primary Examiner*—John P. McIntosh
*Attorney, Agent, or Firm*—William S. Dorman

[57] ABSTRACT

An apparatus for circumnavigating a dispenser about a pipe includes a frame carrying a pair of endless belts locateable on the pipe and carrying the dispenser. The belt carrying frame is hinged to a semi-circular frame, together to encircle the pipe. A locking assembly interconnects the belt carrying and semi-circular frames to secure the frames to the pipe, and a motor on the dispenser carrying frame rotates the endless belts to propel the frames and dispenser around the pipe.

6 Claims, 8 Drawing Figures

APPARATUS FOR CIRCUMNAVIGATING A DISPENSER ABOUT A PIPE OR THE LIKE

BACKGROUND OF THE INVENTION

1. Field of the Invention

This invention relates to improvements in dispenser carrying apparatus and more particularly to improvements in apparatuses for circumnavigating a dispenser about a pipe or the like.

2. Description of the Prior Art

In many instances, it is desirable to provide protective coatings for pipe sections, tanks, or other cylindrical objects buried in the ground or otherwise exposed to the environment or deleterious influences. While a variety of methods and apparatus have been devised to accomplish an objective of coating the outer surface of a pipe or tank, there remains a need for an apparatus, particularly a powered apparatus, useable in the field, directed toward achieving a uniform coating on the pipe particularly adjacent the exposed interface or joint between two adjacent pipe or tank sections after welding or other joining and sealing processes. This need is particularly significant in the absence heretofore of any apparatus for uniformly dispensing a powder coating such as powdered epoxy resin about the outer surface of the tank or pipe section of interest.

This need can be more fully appreciated, for example, from an understanding of a typical installation procedure used in fabricating a pipeline. Commonly, the pipe sections are pre-coated along their length with a protective coating, such as epoxy or other material resistant to the elements to which the pipe will be exposed. However, to facilitate fastening adjoining pipe sections, especially sections to be but welded together, an area adjacent the ends of each pipe sections usually are left uncoated, so that the coating material precoated on the pipe will not interfere with the welding processes. Then, after the weld has been effected, the areas adjacent the joint as well as the weld itself are coated, so that the entire length of the pipe formed is covered with a continuous protective coating.

In the past, the coating has been achieved simply by manually painting or spraying the coating material on the sections, and often, after the coating material is applied, it is heated, by such as induction heaters to cure the coating material or to enhance its durability and quality.

However, in such manual spraying or coating, it is particularly difficult, as well as time consuming, to achieve a suitable coat of uniform thickness for maximum protection. Furthermore, although the particular type of coating material used depends upon the particular installation of interest, it has been found that in many applications if the coating material is applied in powder form and subsequently cured, such as by heating, a particularly high quality coating can be achieved. Such powder application in the field or in remote regions where the actual welding takes place, however, presents additional problems in handling the material, depositing it upon the pipe, and, in general, in achieving a coat around the pipe of uniform thickness and quality.

As hereinafter set forth, the prior art fails to suggest any apparatus suitable for this need, especially without necessitating extensive handling and movement of the pipe sections prior and subsequent to the coating operation. Even where extensive handling and movement of the pipe or tank sections to be coated has not been necessary, the prior art devices are primarily directed to use with particular structures, such as the vertical tank as shown in U.S. Pat. No. 2,476,299. This patent discloses a relatively complex vertical tank or standpipe coating device, having a coating machine adjacent to the outer tank periphery, suspended by a cable hanging from a carriage mounted on top of the tank. To ensure contact between the coating machine and the periphery of the tank, a cable is passed around the tank with both ends secured by a clamp mounted on the coating machine. The device is primarily intended for use with tanks having substantial diameters; and its use is specifically directed to use with vertically positioned tanks.

Other pipe coating or painting devices have been disclosed; for example, U.S. Pat. No. 3,674,546, shows a coating device including a track carried vehicle for carrying a pipe to be coated past a stationary coating applicator located adjacent the tracks. The disclosure clearly provides that the entire length of pipe, including its junctions, be moved past the stationary coating applicator. A similar device, shown in U.S. Pat. No. 2,470,994, presents a relatively complex paint sprayer for a flag pole, which rides the longitudinal length of the implaced pole.

In view of the above, it is evident that the prior art fails to make any showing or suggestion of any apparatus specifically directed toward coating the interface between two adjacent pipe-like sections or of uniformly dispensing a powder about their peripheries.

SUMMARY OF THE INVENTION

In light of the above, it is an object of the invention to present an apparatus for circumnavigating a dispenser about a pipe or the like.

It is a further object of the invention to present an adjustable clamp to removably secure, to a pipe or the like, an apparatus for circumnavigating a dispenser thereabout.

It is another object of the invention to present a powered means for circumnavigating a dispenser about a pipe or the like.

It is yet another object of the invention to present a dispenser driven by a pair of endless belts about a pipe or the like.

It is still yet a further object of the invention to present a dispenser carried on a power driving apparatus supported by at least one endless belt rotatably actuated by the power driving apparatus and thereby providing for circumnavigation of the dispenser about the periphery of a pipe or the like.

These and other objects, features and advantages of the invention will become apparent to those skilled in the art from the following detailed description when read in light of the attached drawing and appended claims.

In accordance with the invention, an apparatus for carrying and circumnavigating a dispenser about the periphery of a pipe or the like is presented. The apparatus includes a power driving apparatus carrying the dispenser and an endless belt means supporting and propelled by the driving apparatus, rideably on the pipe. The apparatus includes a semicircular frame to enable the power driving apparatus, dispenser, and endless belt means to be secured to the pipe, to maintain the position of the dispenser while enabling its movement about the pipe during coating operations.

In accordance with an alternative embodiment of the invention, an apparatus is presented which includes a power driving apparatus carrying the dispenser and an endless belt means supporting and propelled about the pipe by the driving apparatus. A pair of interconnectable semicircular frames are rotatably attached at each end of the power driving apparatus to completely encircle the pipe to which the material from the powder dispenser is to be applied. A locking mechanism can be operated to securely interconnect rods on the respective semicircular frames to maintain them in their encircled relationship upon the pipe. In use, the apparatus is secured to the portion of the pipe to be coated, and the power driving apparatus then rotatably propels the endless belt means to effect circumnavigation of the dispenser about the pipe.

BRIEF DESCRIPTION OF THE DRAWING

The invention is illustrated in the accompanying drawing, wherein.

In the various figures of the drawing, like reference numerals are used to denote like parts.

DETAILED DESCRIPTION OF THE PREFERRED EMBODIMENTS

Figure 1:
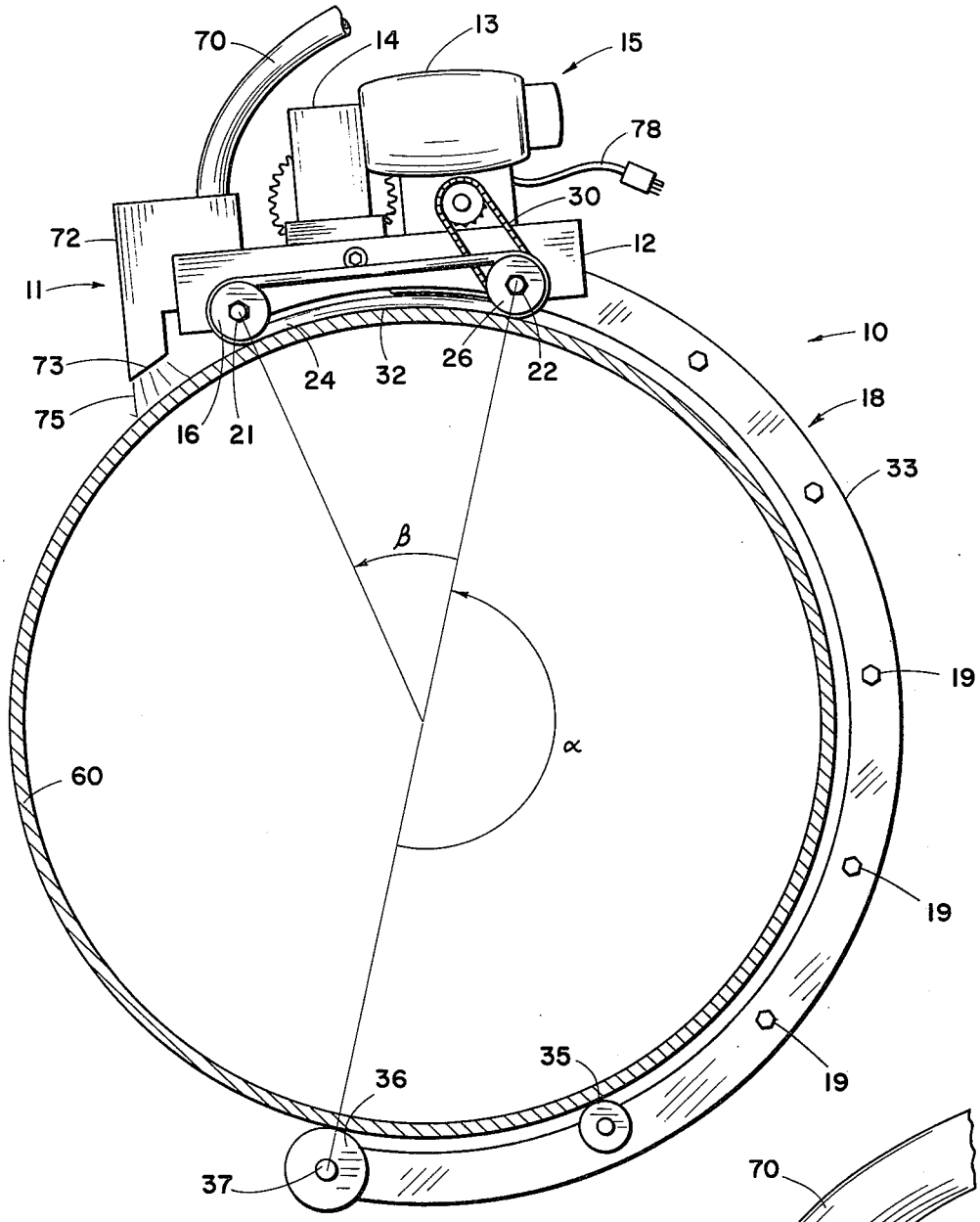
FIG. 1 is a side elevational view of the dispenser carrying apparatus, in accordance with the invention, operably secured to a pipe.

An apparatus for moving a dispenser for applying a coating, such as of powder or the like, about the periphery of a pipe, in accordance with the invention, is illustrated in FIG. 1 and is generally indicated by reference numeral 10. The apparatus has two main assemblies, a driver head assembly 15 and a clamping frame 18 to which the driver head assembly 15 is hinged by a rod 22.

The dispenser 11 is carried upon the driver head assembly 15 and is shown and herein described as a powder dispenser, although well known liquid spraying or other liquid or fluid applicator devices can be used, as desired. The driver head assembly 15, shown particularly in FIGS. 2–5, includes, mounted on a base 12, a motor 13 for supplying the moving power through a gearbox 14 to a pair of flexible endless belts 24 and 25. The endless belts 24 and 25 are located on support pulleys or wheels 16, 17, 26, and 28, the pulleys 16 and 17 being mounted on the ends of a rod 21 transversly disposed through a forward portion of the sides 52 and 53 of the base 12, and the pulleys 26 and 28 being mounted on the ends of the hinge rod 22 through a rearward portion of the sides 52 and 53 of the base 12. Thus, the endless belts 24 and 25 are rotatably disposed about the pulleys 16 and 26 and pulleys 17 and 28, respectively. For convenience in locating the endless belts around their respective pulleys, the pulleys can be fabricated, as shown, each to present a belt receiving notch or groove around its circumference.

The clamping frame 18 includes a pair of bars or frames 33 and 34, each of approximately semi-circular configuration, interconnected by one or more rods (not shown), held in place by bolts 19, to space the frames apart. The two frames 33 and 34 illustrated provide a degree of stability to the overall apparatus, and enable the apparatus to be operated without the frames interfering with the powder dispensed or deposited onto the pipes, the powder (not shown), for instance, being disposed from the dispenser 11 onto the pipe in an area lying between the frames 33 and 34. It should be noted, however, that depending upon the use of the apparatus, the material deposited, and other such factors, the clamping frame 18 can be fabricated with only a single frame member, such as the frame member 33. It should be noted that since the frame members 33 and 34 are of semi-circular configuration adapted to be placed to encircle the pipe 60, the apparatus 10 is principally useable on pipes having approximately the same or slightly smaller outside radius as the radius of the frames 33 and 34, as continued by the dispenser head 15, although some degree of variance is permitted by virtue of the wheels 35 and 36, of the degree of play in the rotation of the dispenser head 15, and of the amount of flexibility presented by the flexible belts 24 and 25. By appropriate modification of the configuration of the clamping frame 18, it can be seen that an apparatus can be achieved which can accommodate other or various sided pipes, tanks, or other cylindrical objects.

Figure 2:
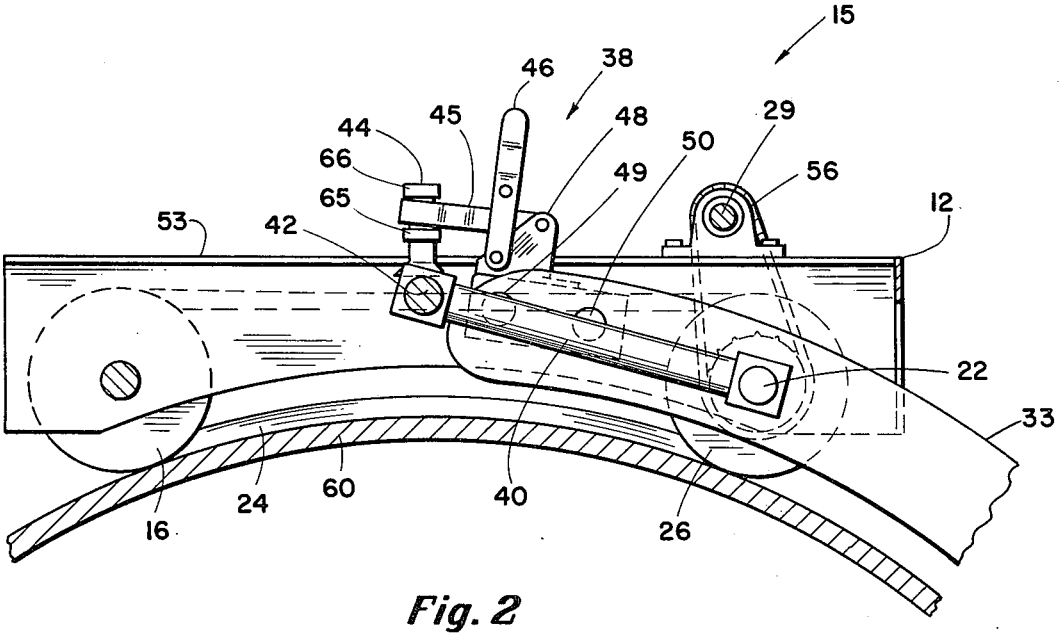
FIG. 2 is a side elevational view, partially cut away, of the driver head of the apparatus of FIG. 1 in a "closed" or secured position.
Figure 3:
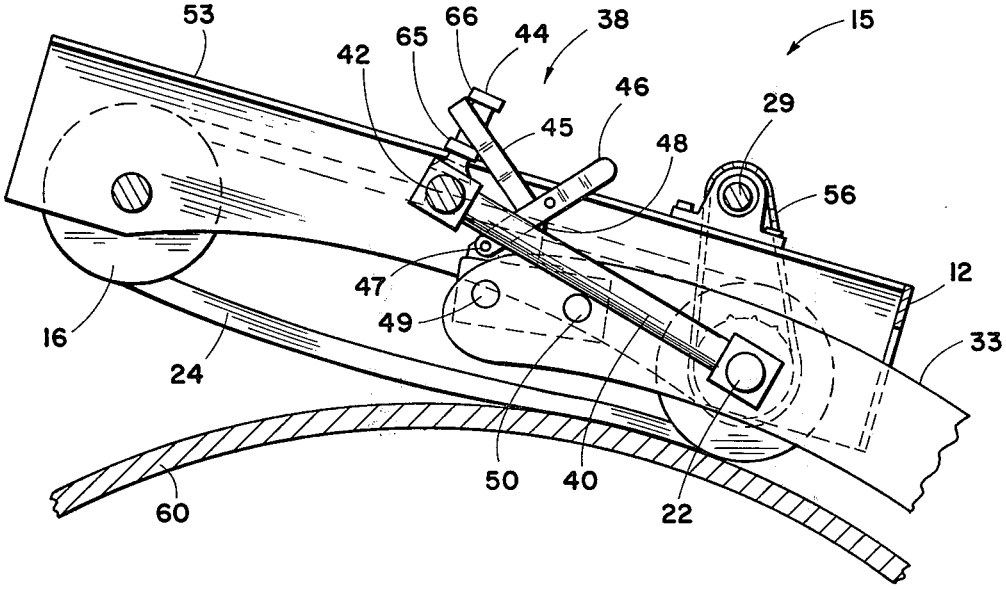
FIG. 3 is a side elevational view, partially cut away, of the driver head of FIG. 2 in an "open" or unsecured position.
Figure 4:
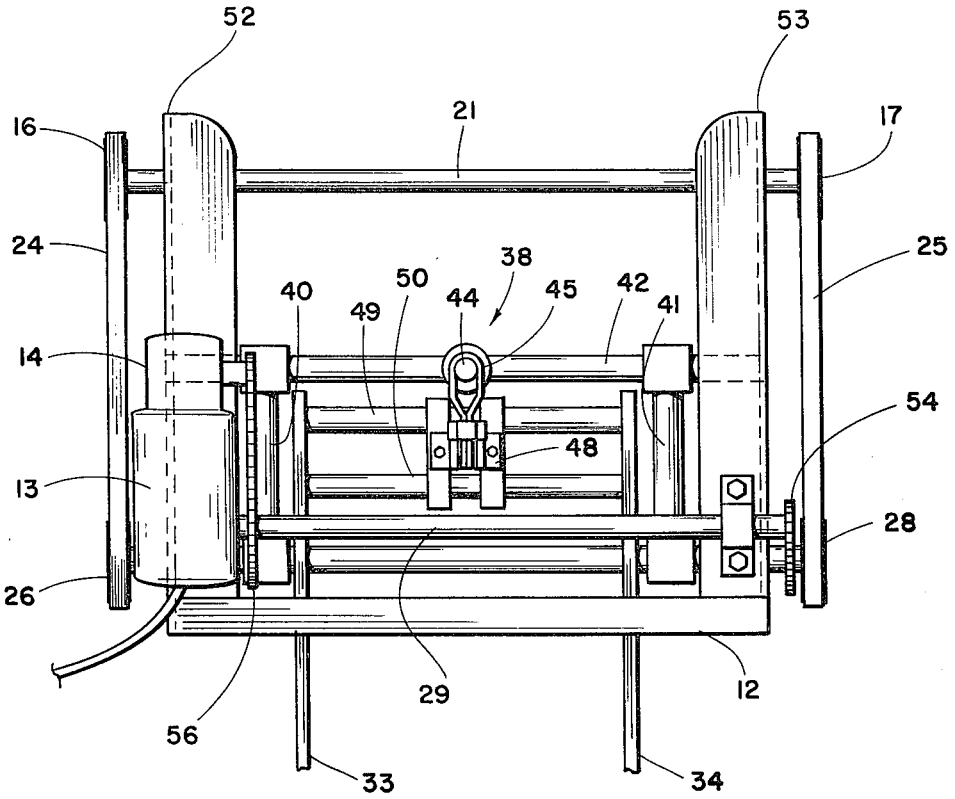
FIG. 4 is a plan view of the driver head of FIG. 2 in the closed position, with the dispensing means removed.
Figure 5:
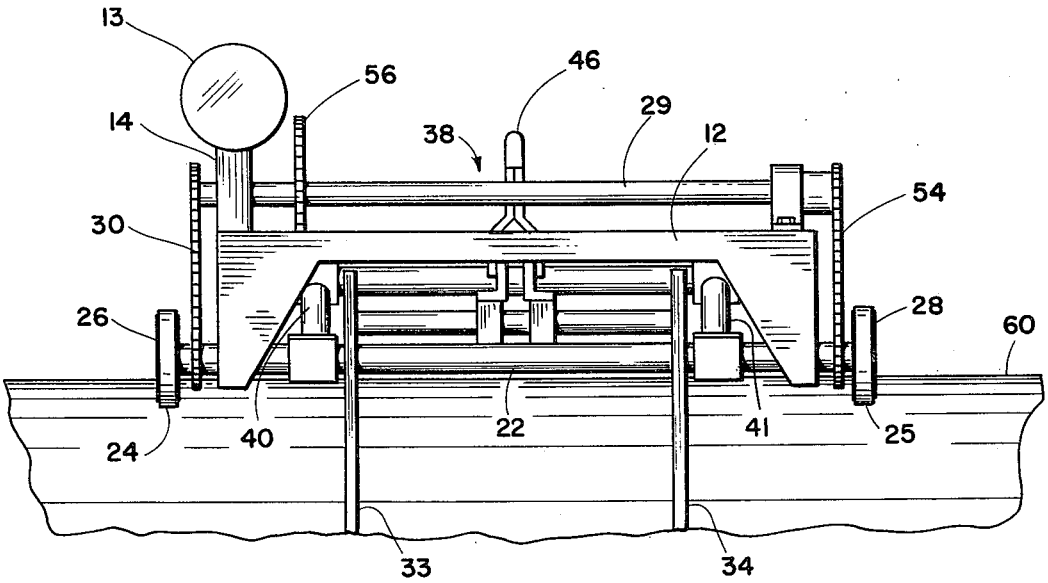
FIG. 5 is a rear elevational view of the driver head of FIG. 4.

To enable the apparatus 10 to be secureable to the pipe 60, the driver head assembly 15 is moveable between the open position, shown in FIG. 3 and the closed position shown in FIG. 4 by virtue of its hinged connection to the clamping frame 18. Because the clamping frame 18 is approximately semi-circular, surrounding an angle 2 and of approximately 180° (see FIG. 1) it can be easily located upon the pipe 60. When the driver frame 15 is moved from the open position shown in FIG. 3 to the closed position shown in FIGS. 1 and 2, the effective angular length of the apparatus is increased by the angle B (see FIG. 1) contributed by the driver head 15. Thus, the total angular length is greater than 180°, and the apparatus can be locked onto the pipe 60. The apparatus thereby provides for engagement and positioning of the dispenser 11 on the pipe 60 while enabling movement of the dispenser 11 about its periphery during coating operations. It should be particularly noted that no additional external support mechanism is required for operation of the device.

The locked position of the dispenser head 15 is maintained by a clamp assembly 38 shown particularly in FIGS. 2–5. A pair of linkages 40 and 41 are each pivotally secured to the hinge rod 22 at one end and at the other end to a cross member 42 secured between the lateral sides 52 and 53 of the base 12 to stabilize the dispenser head 15 and lend strength to the overall structure. Between the linkages 40 and 41, and outstanding from the cross member 42 is a rigidly secured outstanding linkage post 44. A clamp-actuating, locking-yoke lever 46 is pivotally secured by a pin 47 at its yoke end to a base 48, which is rigidly secured to a pair of transverse rods 49 and 50 between the lateral sides 52 and 53, at a position longitudinally corresponding to the linkage post 44. A connecting yoke 45, enclosed at its yoke end, is located about the linkage post 44 and extends between the yoke of the locking lever 46 from the linkage post 44 to the platform 48. The enclosed yoke 45 is rotatably connected to the platform 48 by a pin 61, as shown in FIG. 4, and the enclosed yoke end is constrained against vertical movement upon the linkage post 44. (The upper linkage collar 66 has been omitted in FIG. 4 to show the interrelationship between the enclosed yoke 45 and the linkage post 44). The enclosed yoke 45 is located within the of the yoke lever 46 so that the yoke lever 46 engages the connecting yoke 45 to prevent upward movement of the connecting yoke 45 when the yoke lever 46 is in an upright position, as shown in FIG. 2. On the other hand, when the yoke lever 46 is moved to a rearward position, as shown in FIG. 3, the connecting yoke 45 does not engage the lever yoke 46, which is then free to move upwardly. The dispenser head 15 is therefore positioned and secured by rotating the locking lever 46 toward the dispenser 11 to maintain the pulleys 16, 17, 26, and 28, and the belts 24 and 25 in engagement with the pipe 60.

To enable the frame assembly 18 to freely travel on the pipe 60, the frames 33 and 34 have a transverse rod 37 rigidly secured at their ends away from the dispenser head 15. A pair of wheels, (wheel 36 shown in FIG. 1), are rotatably secured to the transverse rod 37, and a similar pair of wheels (wheel 35 shown) is also rotatably secured to the frames 33 and 34. The pairs of wheels 35 and 36 enable the frames 33 and 34 to engage and secure the apparatus to the pipe 60, the wheels rollably engaging the periphery of the pipe and supporting the frames above the surface of the pipe, thereby facilitating movement of the apparatus about its peripheral surface.

As hereinbefore set out, a power source to simultaneously rotate the belts 24 and 25 when the apparatus is secured to the pipe 60 to propel the apparatus thereabout. As particularly illustrated by the structure shown in FIGS. 4 and 5, the apparatus includes a power source such as the electric motor 13, which receives its electric power by a cable 78 connectable to an electric power generator (not shown) or other source of electric power. In use in field operations, typically electric generators are conveniently available, being used, for instance in other pipeline installation operations, such as the activation of heaters for pre-and-post stressing the pipe metal for welding, and so forth. The electric motor 13 imparts its rotational force via the gearbox 14 to a shaft 29 through a pulley and chain or belt 56. The rotational motion of the shaft 29 is, in turn, imparted to the wheels 16 and 17 by pulleys and chains or belts 30 and 54 to drive the belts 24 and 25 and move the apparatus about the pipe.

Figure 6:
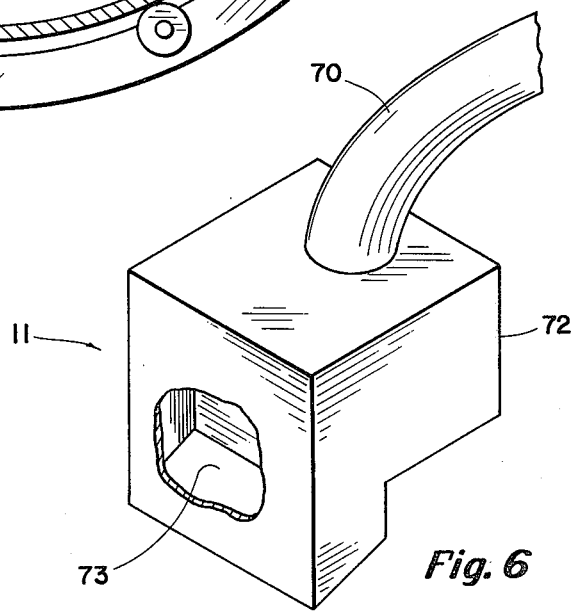
FIG. 6 is a perspective view partially cut-away of the dispenser mounted on the driver head.

Finally, the powder dispenser 11, as shown in FIG. 6, is a box 72 open at one end 73 to enable the powder to be dispensed. A tube or pipe 70 communicates to within the box 72 to conduct the powder from a powder source (not shown) thereto. The powder dispenser 11 can then be mounted in a central position of the dispenser head 15 by braces or brackets (not shown) at a forward location illustration in FIG. 1. The open end 73 is located, therefore, to enable the dispensed powder 75 to be deposited directly onto the surface of the pipe 60.

In operation, the apparatus 10 is located upon the pipe 60 and secured in the position shown in FIG. 1 by moving the yoke lever 56 of the locking assembly to the locked position, as shown in FIG. 2. The powder to be deposited which is suspended within a carrier medium, such as air or other gas, is then conducted within the pipe 70 from a source (not shown) and introduced to within the dispenser 11. The powder is thereafter expelled from the open side 73, as shown by the lines 75 in FIG. 1, to be deposited upon the pipe 60.

The motor 13 is simultaneously activated to drive the apparatus 10 around the pipe, thereby enabling the dispenser 11 to deposit the powder entirely around the circumference of the pipe 60. The apparatus 10 is then removed from the pipe and relocated at the next location at which the powder is to be deposited. The area at which the powder has been dispensed can then be treated or cured, if desired, as necessary.

Figure 7:
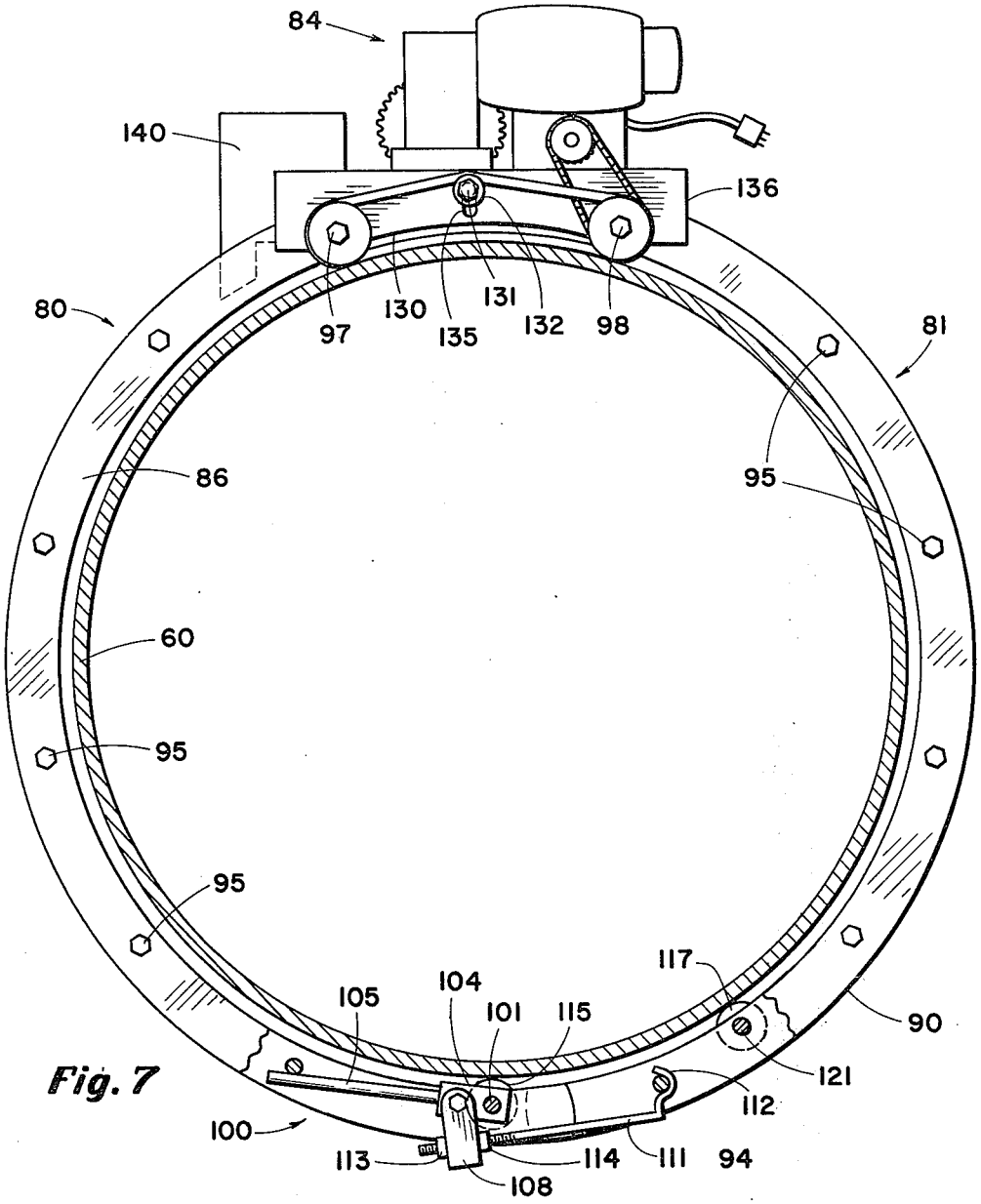
FIG. 7 is a side elevational view, partly cut-away, of an alternative embodiment of the dispenser carrying apparatus, in accordance with the invention, operably secured to a pipe.
Figure 8:
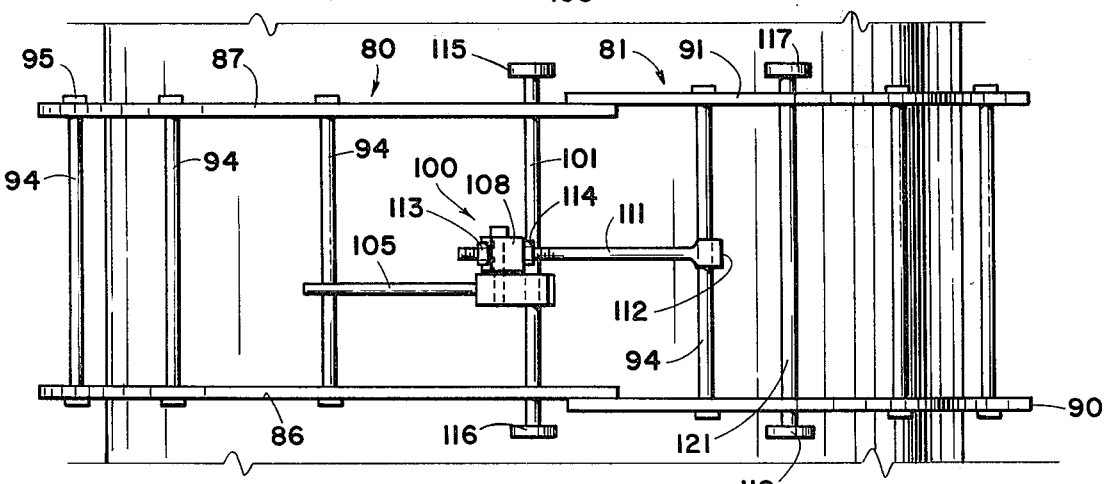
FIG. 8 is a bottom elevation of the apparatus of FIG. 7.

An alternative embodiment of the invention is shown in FIGS. 7 and 8. In the alternative embodiment shown, two semicircular frames 80 and 81 are rotatably attached to a driving head 84, which is of similar construction to the driving head 15 above described with reference to FIGS. 1–3. More specifically, the frames 80 and 81 each include semicircular members 86 and 87, and 90 and 91, respectively. The semicircular members 86, 87, 90, and 91 are connected in pairs by rod members 94 held in place by bolts 95 to form the semicircular frame shown. One of the rods 94 at one end of the semicircular frame 80 serves as an axle 97 of the powder dispensing head 84. Likewise, one of the rods 94 at one of the ends of the semicircular frame 81 serves as an axle 98 at another portion of the driving head 84. Thus, the semicircular frame 80, the driving head 84, and the semicircular frame 81, are locatable to completely encircle the pipe 60 onto which material from the powder dispensing head 84 is to be deposited.

To securely hold or lock the semicircular frames 80 and 81 in their encircling relationship, a lock mechanism 100 is provided. The lock mechanism 100 is rotatably attached to a rod 101 extending between the semicircular members of one of the semicircular frames 80 or 81, such as between the members 86 and 87 of the semicircular frame 80, as shown. The rotatable connection to the rod 101 is effected by a bearing member 104 having a hole through which the rod 101 extends. The rotational location of the bearing 104 is controlled by a handle or rod 105 attached at one end of the bearing 104. A second bearing 108 is carried upon the bearing 104, upon a shaft 109 in a hole off-set from the hole through which the rod 101 passes. The second bearing 108 carries a rod 111 securely therein. A hooked portion 112 is provided on the opposite end of the rod 111 which serves to engage one of the interconnecting rods 94 of the other semicircular frame, such as the semicircular frame 81 shown particularly in FIG. 8. Thus, as the handle 105 is rotated, because the shaft 109 is off-set from the axis of the rod 101, the rod 111 will be pulled or pushed in the direction of rotation. Thus, the hook 112 upon the rod 111 can be located upon one of the separating rods 94, and the handle 105 rotated to the position shown in FIGS. 7 and 8, to draw the semicircular frames 80 and 81 together to maintain their spaced relationship encircling the pipe 60. If desired, the rod 111 can be threaded at one end to receive nuts 113 and 114 to enable the length of the rod 111 to be adjusted. This may be necessary, for example, to accomodate pipes of slightly different diameter, although, it should be appreciated, that in the utilization of the device in accordance with the alternative embodiment of the invention, the range of diameters of pipes with which the apparatus can be used is relatively fixed.

To assist the apparatus in circumnavigating the pipe 60, one or more pairs of wheels, such as wheels 115, 116, 117, and 118 can be provided on shafts at the ends of the semicircular frames 80 and 81 opposite the powder dispensing head 84. As shown, wheels 115 and 116 are rotatably mounted upon the rod 101 in the semicircular frame 80, and wheels 117 and 118 are rotatably mounted on a second rod 121, in the semicircular frame 81.

Another feature shown in the alternative embodiment of FIG. 6 is means for adjusting the tension of the driving belt 130 of the dispensing head 84. This adjustment is realized by a rod or shaft 131 which carries a pulley at each end, pulley 132 being shown. The shaft is located in a slot 135 in the base 136 of the powder dispensing head 84 to be moveable up and down, thereby to adjustably remove the slack in the driving belt 130. In the embodiment shown, the remainder of the parts or components of the powder dispensing head 84 are of similar construction to those of the powder dispensing head 15 above described with reference to FIG. 1. It should be noted that although in the alternative embodiment illustrated in FIGS. 7–8, the locking mechanism 100 is shown joining the free ends of the semi-circular frames 80 and 81 away from the dispersing head 84, if desired, the mechanism can be located at another joint in the apparatus. For example, the locking mechanism 100 can be employed in place of the rotational connection between either of the semicircular frames 80 and 81 the embodiment of FIGS. 7–8 replaced by a rotational connection.

The operation of the apparatus, in accordance with the alternative embodiment of the invention above described, is essentially the same as that of the apparatus described with reference to FIGS. 1–6. The apparatus is located on the pipe with semicircular frames 80 and 81 around the pipe with the flexible endless belts 130 of the driving head 84 resting upon the outer circumference of the pipe, thereby completely encircling it. The locking mechanism 100 is actuated by rotating the handle 105, to secure the semicircular frames 80 and 81 in the encircling relationship, with the hook 112 engaging one of the interconnecting rods 94 with a shaft 101, or other interconnecting rod of the semicircular frame 80. The apparatus is then energized, and driven around the circumference of the pipe, while concurrently applying material from the dispenser 140 to the pipe.

It should also be noted that in the operation of the apparatus of either FIGS. 1–6 or 7–8, to ease the logistical problems encountered in carrying the powder carrying tubes, electrical power to the motor of the driving unit, and other connecting lines, after the apparatus is located on the pipe 60, it can be driven, for example, 360° in one direction, then reversed, and driven 360° in the other direction, bringing the dispenser head, and the associated pipes and lines, back to its original starting position.

Although the invention has been described and illustrated with a certain degree of particularity, it is understood that the present disclosure has been made only by way of example and that numerous changes in the details of construction and combination and agreement of parts may be resorted to without departing from the spirit and scope of the invention as hereinafter claimed.

What is claimed is:

1. Apparatus for carrying a dispenser circumferentially around a cylindrical object comprising, two frames hinged together to be moveable to a configuration surrounding more than one-half of the circumference of said object, said dispenser being carried upon one of said two frames in dispensing relationship with said object, a lock means connected between said two frames to secure them in surrounding position, a plurality of wheels mounted on said two frames to ride upon said object in said surrounding position, a motor carried on one of said two frames and operably connected to two of said wheels to propel said frames circumferentially about said object, and a pair of flexible belts engaging said pipe in said surrounding position, each mounted between one of said motor connected wheels and another wheel to propel said two frames.

2. Apparatus for moving a dispenser around the circumference of a pipe comprising, a semi-circularly configured frame of radius slightly larger than the radius of the pipe, a head for carrying the material dispenser, hinged to said frame and movable to a lockable position continuing the length of said frame to engage said frame and head to the pipe, a plurality of wheel means carried by said frame and said head to ride upon and space said head and frame above the pipe, and means for driving at least one of said wheel means to propel said frame and head circumferentially around said pipe, said wheel means including at least two wheels on said head and further comprising an endless belt carried between said at least two wheels to ride upon the pipe where said head and frame are engaged thereon.

3. Apparatus for moving a dispenser around the circumference of a pipe comprising, a semi-circularly configured frame of radius slightly larger than the radius of the pipe, a head for carrying the material dispenser, hinged to said frame and movable to a lockable position continuing the length of said frame to engage said frame and head to the pipe, a plurality of wheel means carried by said frame and said head to ride upon and space said head and frame above the pipe, and means for driving at least one of said wheel means to propel said frame and head circumferentially around said pipe, said plurality of wheel means including four wheels carried upon said head, and further comprising a pair of endless belts, each carried between a respective pair of said four wheels to ride upon said pipe when said head and frame are engaged thereon.

4. The apparatus of claim 3 wherein said plurality of wheel means further includes a pair of wheels adjacent an end of said frame away from said head.

5. Apparatus for depositing a powder onto the circumference of a pipe, comprising, a dispenser head assembly, including, a base, a powder dispenser carried upon said base, two pair of pulleys, each pair located on an opposite side of said base, a pair of flexible belts, each mounted between a respective pair of said two pair of pulleys, and motor means carried by said base in rotation transmitting connection with at least one pair of said two pair of wheels to rotate said at least one pair of wheels;

a frame assembly, including, a pair of semi-circular frame members, a plurality of rods interconnecting and spacing apart said pair of frame members, and a pair of wheels mounted at one end of said semicircular frame members;

means hingedly connecting said head assembly to another end of said frame assembly, whereby when said frame assembly and head assembly are located upon the pipe, said head assembly is moveable to a position wherein said two endless belts and said pair of wheels at said one end of said semi-circular frame members engage the pipe, and the angular distance said head assembly and said frame assembly extend around said pipe, is larger than 180°;

and a lock assembly between said head assembly and said frame assembly to maintain said endless belt engaging position.

6. Apparatus for carrying a dispenser circumferentially about a pipe comprising, a first partially-circular frame for carrying the dispenser, second and third partially-circular frames, rotatably connected to said first frame, adapted to be located encircling the pipe, means for interconnecting said second and third frames in said encircling location, a plurality of wheels carried by said second and third frames for moveably supporting said first, second and third frames upon said pipe, and motor drive means carried upon said first frame in a location to engage said pipe when said first, second and third frames are in said encircling location, for moving said first, second and third frames circumferentially around the pipe, said motor drive means comprising two flexible belts for engaging the pipe, two pair of belt pulleys each carrying one of said two belts, attached to said first frame, a motor carried upon said first frame, and motor rotation transmission means interconnecting said motor and at least one of said pulleys to move said belts upon the pipe.

* * * * *